US007364048B2

(12) United States Patent
Cautereels et al.

(10) Patent No.: US 7,364,048 B2
(45) Date of Patent: Apr. 29, 2008

(54) CHEESE SERVER

(75) Inventors: Victor J. J. Cautereels, Ranst (BE); Johan M. J. K. Mortier, Grimminge (BE); Jean-Marie De Craim, Buggenhout (BE)

(73) Assignee: Dart Industries Inc., Orlando, FL (US)

( * ) Notice: Subject to any disclaimer, the term of this patent is extended or adjusted under 35 U.S.C. 154(b) by 317 days.

(21) Appl. No.: 10/611,707

(22) Filed: Jul. 1, 2003

(65) Prior Publication Data

US 2005/0000963 A1 Jan. 6, 2005

(51) Int. Cl.
*B65D 51/16* (2006.01)
*B65D 81/18* (2006.01)

(52) U.S. Cl. ..... 220/254.7; 220/371; 220/791; 215/261; 215/308

(58) Field of Classification Search ..... 220/254.1, 220/254.3, 254.7, 371, 372, 789, 791; 215/261, 215/307, 308
See application file for complete search history.

(56) References Cited

U.S. PATENT DOCUMENTS

| | | | | |
|---|---|---|---|---|
| 672,692 | A * | 4/1901 | Bailey | 215/308 |
| 3,083,861 | A * | 4/1963 | Amberg et al. | 220/371 |
| 4,000,839 | A * | 1/1977 | Tecco et al. | 222/540 |
| 4,136,796 | A * | 1/1979 | Dubois et al. | 220/259.4 |
| D270,322 | S * | 8/1983 | Daenen et al. | D7/629 |
| 4,566,377 | A | 1/1986 | Van Buytene | |
| D307,554 | S | 5/1990 | McAlister | |
| 4,932,549 | A * | 6/1990 | Gouttefangeas | 220/254.7 |
| D318,982 | S | 8/1991 | Gecchelin | |
| D319,165 | S | 8/1991 | Gecchelin | |
| 5,221,000 | A * | 6/1993 | Lee | 206/77.1 |
| 5,373,779 | A | 12/1994 | Grusin | |
| D367,211 | S | 2/1996 | Cautereels | |
| 5,515,994 | A * | 5/1996 | Goglio | 220/372 |
| D372,641 | S | 8/1996 | Betend-Bon | |
| 5,649,639 | A * | 7/1997 | Dolvet et al. | 220/257.1 |
| D382,445 | S | 8/1997 | Indekeu | |
| 5,730,311 | A * | 3/1998 | Curtis | 220/371 |
| 5,931,333 | A | 8/1999 | Woodnorth et al. | |
| 5,988,414 | A * | 11/1999 | Schwarz et al. | 215/261 |
| 6,145,687 | A * | 11/2000 | Nichols et al. | 220/254.3 |
| 6,237,765 | B1 * | 5/2001 | Hagen et al. | 206/315.11 |
| D447,688 | S | 9/2001 | Jalet et al. | D9/425 |

(Continued)

FOREIGN PATENT DOCUMENTS

| | | |
|---|---|---|
| DE | 29507648 | 8/1995 |

(Continued)

OTHER PUBLICATIONS

Pebax Resin—Copyright 2000 Atofina Checmicals, Inc., 2 pages.
Tefal Vegetable Storer, Tefal S.A., France, 5 pages.

*Primary Examiner*—Anthony D. Stashick
*Assistant Examiner*—James N Smalley

(57) ABSTRACT

A cheese server including a flat serving tray with an upwardly domed closure mountable thereover and including an enlarged vent opening generally parallel to and aligned over the tray with the vent opening closed by a removable vent panel having multiple openings therethrough with the openings overlaid by a venting foil of a material which is both waterproof and has a predetermined degree of vapor permeability.

17 Claims, 6 Drawing Sheets

U.S. PATENT DOCUMENTS

| | | | | |
|---|---|---|---|---|
| 6,367,651 | B2 | 4/2002 | Laib et al. | 220/676 |
| 6,468,332 | B2 | 10/2002 | Goglio et al. | 96/134 |
| 6,862,980 | B2 * | 3/2005 | Heil et al. | 99/467 |
| 6,877,629 | B2 * | 4/2005 | Meyer | 220/212 |
| 6,883,675 | B2 * | 4/2005 | Maenke | 220/203.11 |

FOREIGN PATENT DOCUMENTS

| | | | |
|---|---|---|---|
| EP | 0734972 | | 10/1996 |
| EP | 1041010 | | 10/2000 |
| EP | 1151937 | | 11/2001 |
| FR | 2617811 | | 1/1989 |
| FR | 2790245 | | 9/2000 |
| FR | 2790245 | A1 * | 9/2000 |
| GB | 2252712 | | 8/1992 |
| JP | 3054499 | | 9/1998 |
| WO | 97/08077 | | 3/1997 |
| WO | WO 0112412 | | 2/2001 |

* cited by examiner 24
22
14
20
28
30
40
16
46
48
26
18
36
38
34
12

CHEESE SERVER

BACKGROUND OF THE INVENTION

A primary concern with regard to the storage and serving of food products in the home is maintaining the freshness of the food until consumed. The most common means for food preservation includes refrigeration and/or the use of sealed containers, plastic or foil wrapping, and the like.

While storage within containers normally involves the use of airtight containers providing a sealed interior atmosphere, in some instances the food products can best be preserved by allowing for a selective venting of the container. In this regard, attention is directed to U.S. Pat. No. 6,367,651 B2 to Laib et al, assigned to the assignee of the present application and to a deep body vegetable storer, and anti-odor cheese cellar containers, distributed by TEFAL S.A., France. Another container similar to the TEFAL® containers noted will be seen in U.S. Design Pat. No. 372,641, assigned to TEFAL S.A., France. It will be noted in the Laib et al patent and with regard to the TEFAL® storers, that they are concerned with the storing of produce or cheese, which continue to respire and otherwise chemically react to produce gases or vapors which if retained within a sealed chamber with the foodstuff will adversely affect the foodstuff or produce undesirable odors. This would be the case whether the foodstuff be produce or the various types of cheese with which the present application is more particularly concerned. Further, while deep body containers such as TEFAL® are normally used and are particularly acceptable for storage purposes, such containers would be impractical or less than desirable from a standpoint of being of suitable structure that enables disassembly for proper cleaning and sanitizing as would improve their acceptability for use as a cheese server. This is particularly significant for a container which is to be used both to store cheese and allow for a full display of the cheese for ready access thereto for slicing and serving.

SUMMARY OF THE INVENTION

It is a primary object of the present invention to provide a container for the preservation of foods with the container being particularly adapted for use as both a cheese server at the dining table and as a storage container with a highly effective controlled venting capability.

In a typical use cycle, food, such as cheese, is removed from the refrigerator for consumption and the remaining portion is returned to the refrigerator after use. In a tradition a closed container, the cover would be placed on the container trapping ambient air inside. As the container cools down in the refrigerator, water vapor condenses on the interior walls. This moisture is in addition to any vapors and gases that are emitted from the cheese itself.

Pursuant thereto the server is to be vented with the venting of the server controlled by providing for egress of internal gases and vapors which may develop from the contained food or the ambient air in the container, while also acting as a water barrier against ingress of ambient moisture.

The server of the invention includes a base in the nature of a flat tray presenting a supporting cutting surface or "board" for the cheese, a high domed cover which sits on the tray and defines an enclosing chamber for the cheese, and a large vent panel removably mounted over a corresponding opening defined in the top or upper portion of the cover.

The vent panel is provided with a predetermined permeability, preferably by the application, as by fusion bonding to the vent panel, of a thin resin foil, or film, of a predetermined degree of vapor permeability. As an example of such resins, attention is directed to the Pebax® waterproof breathable films, products of Atofina Chemicals, Inc. By the use of such foils or film, the degree of permeability of the vent panel can be formed in accord with the type of food to be stored, ambient conditions, and the like. Basically, several duplicate vent panels can be provided, each with a foil of a different specific permeability to accommodate different conditions.

The vent panel itself snap-locks into the cover opening and is readily removable or disassembled to allow for cleaning and sanitizing, replacement of damaged venting material or the interchangeability with vent panels of differing permeabilities to accommodate the particular cheeses or related foods within the server.

It is particularly intended that the vent panel and the permeable foil fixed thereto, provide an effective outward venting of moisture in the container or vapors generated by the cheese, as by a continued fermenting or aging thereof, which might adversely affect the desirability of the cheese, while at the same time protecting the cheese against the absorption of water or moisture from the ambient environment wherein the server resides. As noted above, materials appropriate for this purpose are known.

The incorporation of the replaceable vent panel into the cover is a particularly attractive feature in that upon a removal of the cover, with the vent panel, the cheese is presented, without any surrounding encumbrances, on the flat serving tray, which forms the base of the container.

Other features, objects and advantages encompassed by the invention will become apparent from the following more detailed description of the invention.

DESCRIPTION OF PREFERRED EMBODIMENTS

Figure 1:
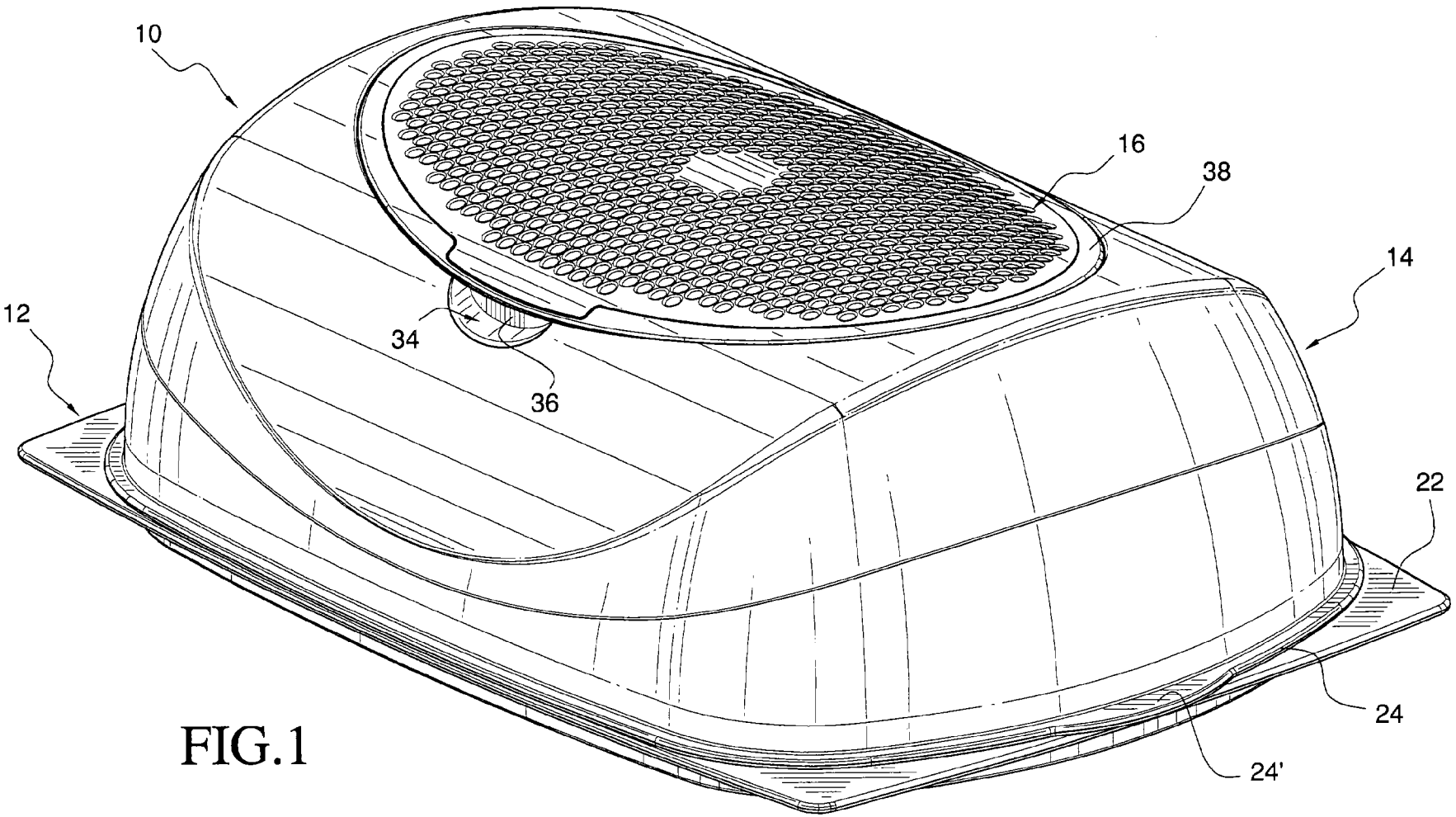
FIG. 1 is a perspective detail of a rectangular embodiment of the invention.

Referring now more specifically to the drawings, the container or cheese server 10 consists of three principal components, a base forming tray 12, a high domed cover 14 and a vent panel 16. The tray 12 provides a support platform and, as desired, a flat cutting board surface for the cheese or other food product. The domed cover 14, removably mounted to and over the tray 12, provides an enlarged enclosing chamber for the cheese. The vent panel 16, which is removable, replaceable and interchangeable with other panels of varying permeabilities, provides for the desired protective venting of water vapor from the container chamber.

While the server 10 can be of any appropriate plan configuration, such as square or circular, in the preferred embodiment of FIGS. 1-5, the server has been illustrated as rectangular with slightly arcuate opposed longitudinal ends.

The tray 12 includes a planar top panel 18 forming the support and serving surface for the cheese. This top panel 18 has a depending base flange 20 peripherally thereabout to rigidify the top panel 18 and provide a support base for the tray. An integral continuous outwardly projecting support ledge 22, at approximately mid-height on this support flange 20, forms a tray handle and both receives and supports the cover 14.

Figure 2:
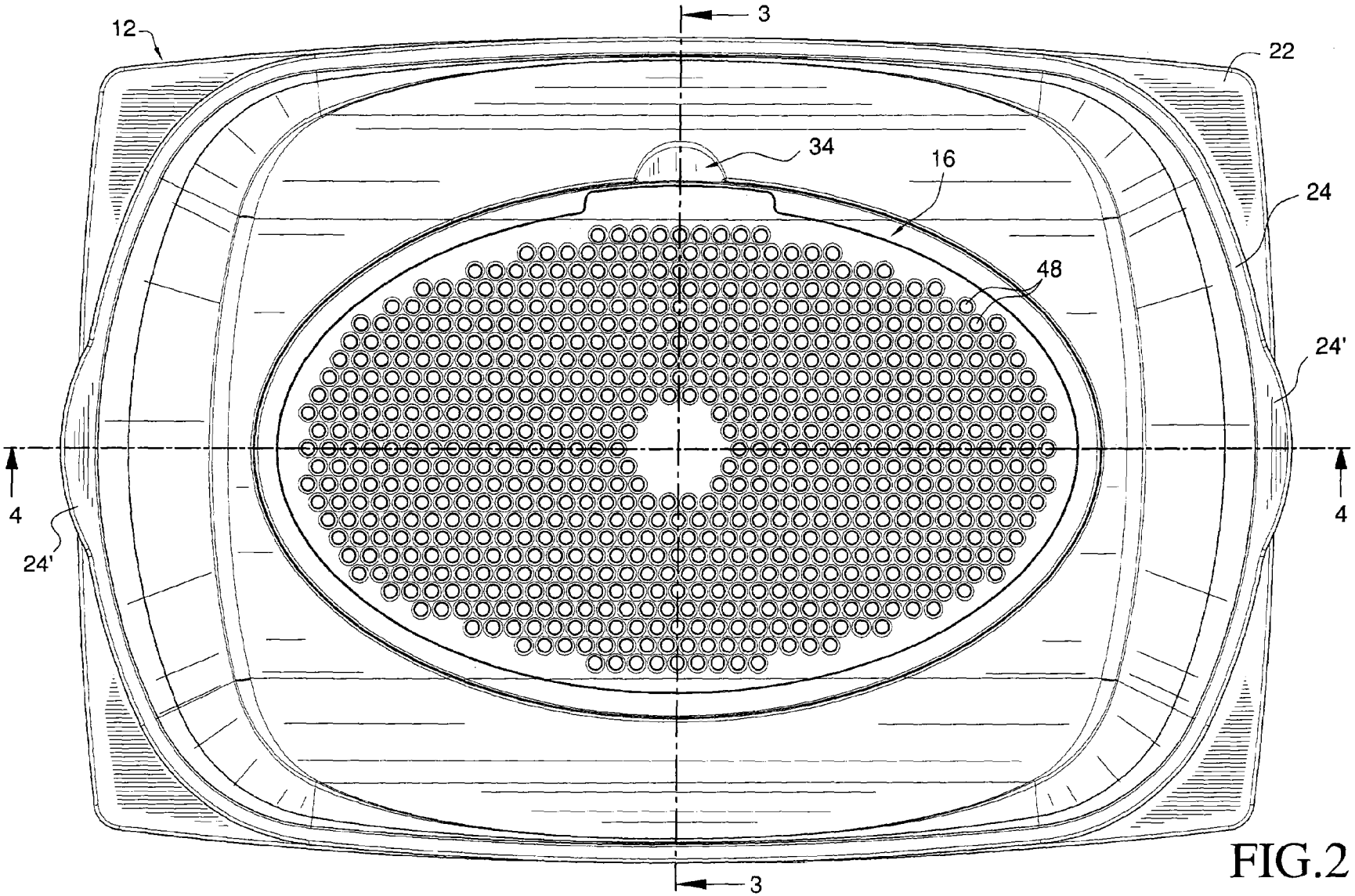
FIG. 2 is a top plan view of the server.
Figure 3:
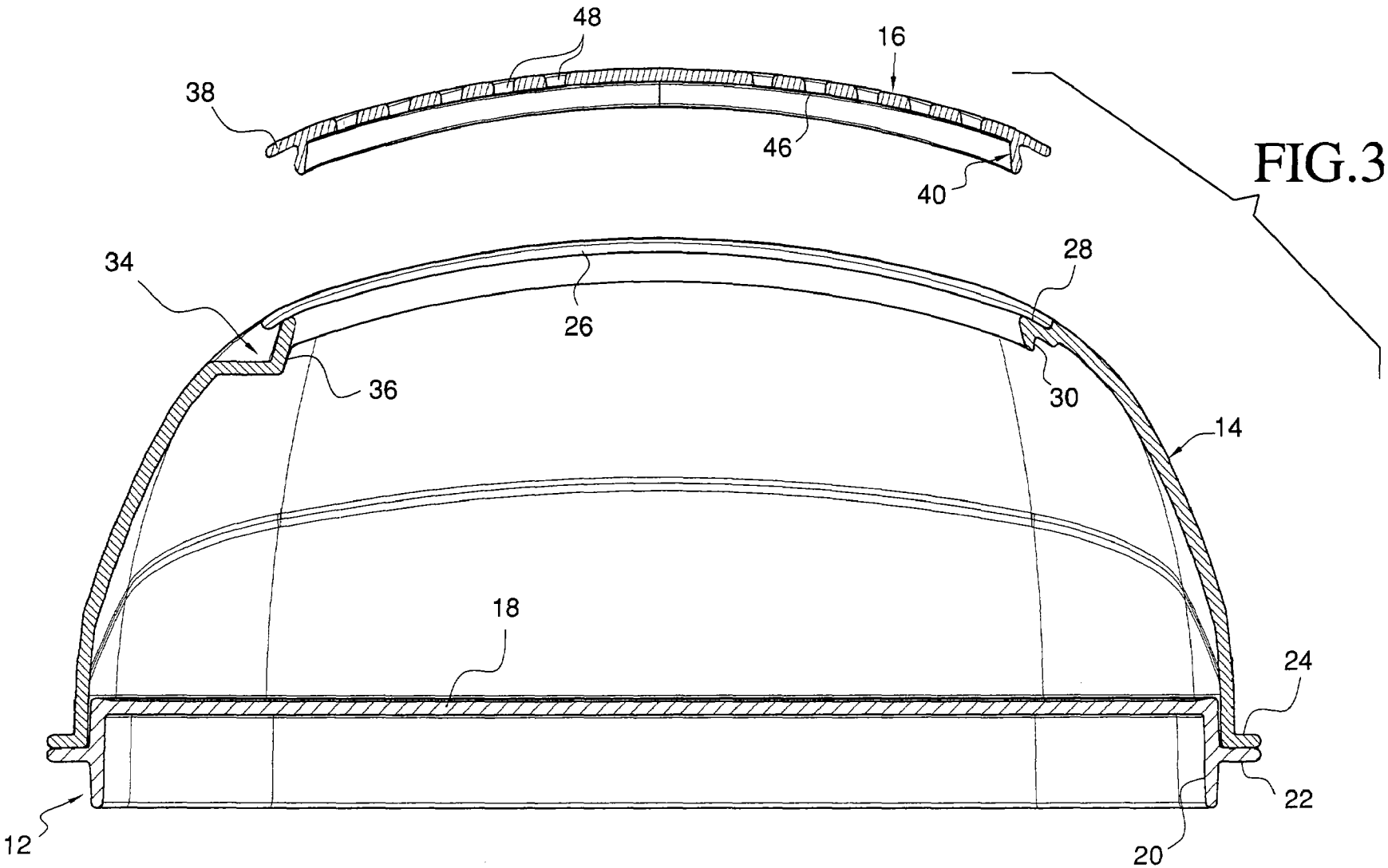
FIG. 3 is a transverse cross-section view taken substantially on a plane passing along line 3-3 in FIG. 2, and with the vent panel upwardly removed.
Figure 5:
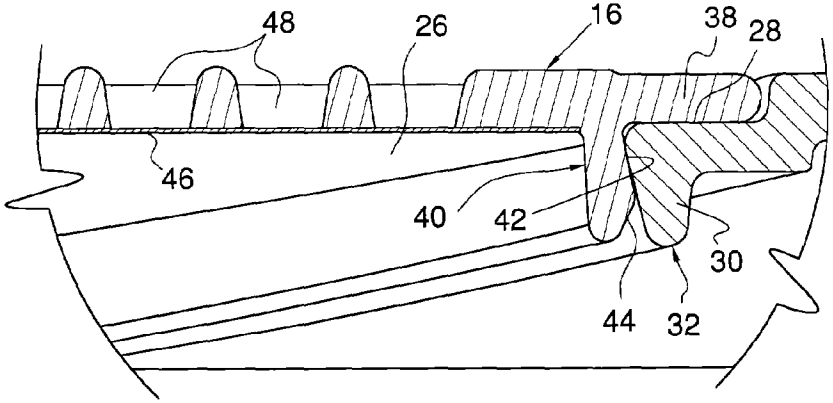
FIG. 5 is an enlarged detail of the area designated as FIG. 5 in FIG. 4.
Figure 4:
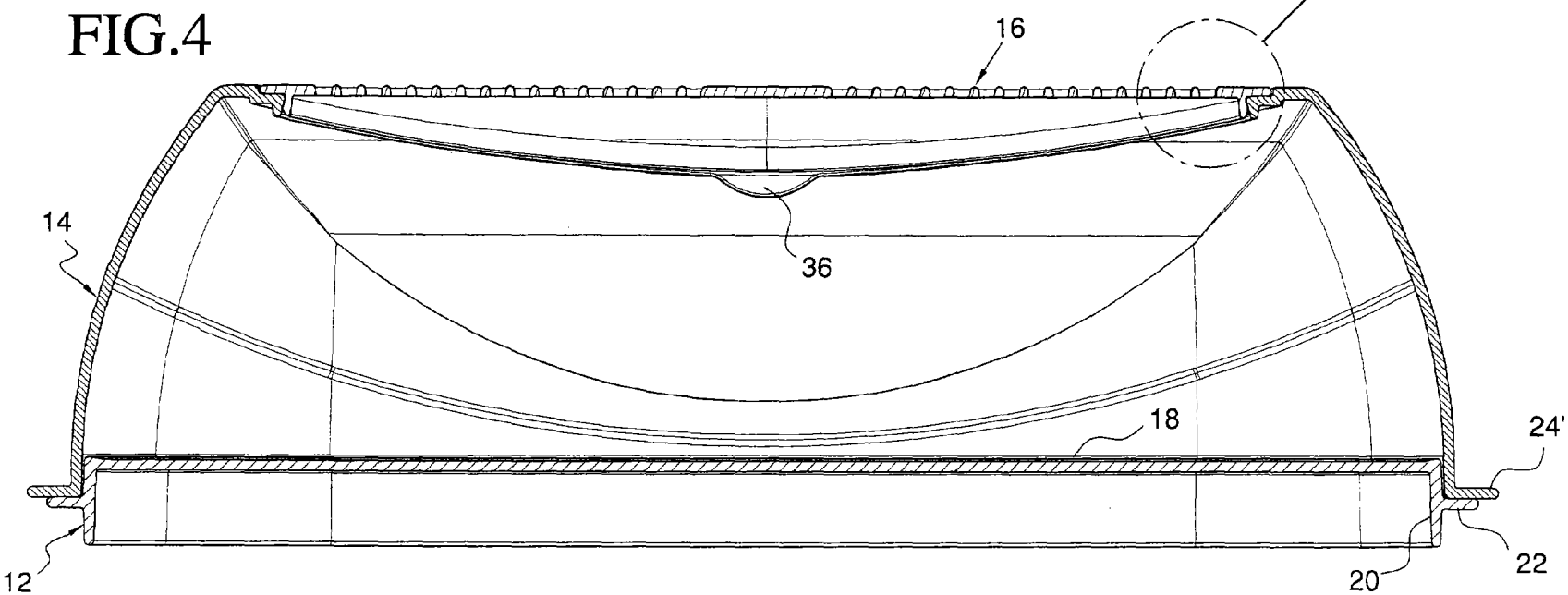
FIG. 4 is a longitudinal cross-section view taken substantially on a plane passing along line 4-4 in FIG. 2.

The cover 14, which is of a generally dome configuration, has a lower peripheral portion including a continuous laterally outwardly turned lip 24 which sits on the tray ledge 22, the cover thus enclosing the upper portion of the tray above the tray ledge 22. This telescopic engaging of the lower portion of the cover 14 about the upper portion of the tray 12 is such whereby while the cover can be easily lifted from the tray, a positive sealing effect is provided therebetween by the seating and intimate engagement of the cover lip 24 on the tray ledge 22. It will also be noted that the lateral extent of the overlying ledge and lip is such whereby the entire server can be readily carried by manually lifting the bottom tray by the peripheral projecting ledge 22 thereon. As seen in FIGS. 2 and 4, selected portions 24' of the cover lip 24 can project slightly outward to form cover handles.

The upper or top portion of the domed cover 14 is formed with an elongate, preferably oval or elliptical vent opening 26 therein. This opening generally conforms to or is aligned with the rectangular configuration of the server. That is, the longitudinal axis of the opening 26 aligns with the longitudinal axis of the server, while the transverse axis thereof aligns with the transverse axis of the server, the vent opening being centrally aligned over the tray.

The cover 14, about substantially the entire extent of the opening periphery, is downwardly offset to provide a peripheral seat 28 for the reception and support of the vent panel 16 as shall be described subsequently. Noting FIG. 5 in particular, the inner edge of the seat 28, which forms a rim that defines the opening, is in turn provided with an integral depending flange 30, the inner face 32 of which is slightly undercut or outwardly and downwardly inclined relative to the opening 26.

At one point or small area about the cover opening 26, the cover 14 has a recess 34 formed therein. The recess is in the nature of a finger hole to accommodate one or more fingers for engagement with and removal of the vent panel 16 as desired. This recess 34 terminates in an upwardly extending inner wall 36, the inner face of which is inclined to correspond with the inclination of the inner face 32 of the flange 30 and is aligned and forms a continuation thereof. Similarly, the extreme upper edge of the recess wall is of an equal height with and forms a continuation of the rim and the seat 28. As will be appreciated, the recess 34, in addition to the inner upwardly extending wall 36, also has a closed bottom and sides in order to maintain the integrity of the cover and chamber defined thereby.

The vent panel 16 is a rigid or substantially rigid perforated panel with the multiple openings therein coextensive with substantially the entire area of the panel. The panel 16, when mounted, will completely overlie the cover opening 26 with the peripheral edge portion 38 of the panel 16 seated on the upper cover seat 28 and upper edge of the recess wall 36. So positioned, a section of the edge portion 38 will overly the finger recess 34 to facilitate engagement therewith for upward removal of the vent panel 16. As will be recognized from FIGS. 1 and 3, the vent panel 16 will be arced to conform to the arcing of the dome configuration of the cover 14. In the rectangular container, this will involve a transverse arcing with little or no arcing in the longitudinal direction.

In order to releasably lock the panel 16 into position, the panel 16 includes a peripheral depending locking ring 40 inwardly spaced from the panel edge portion 38 which engages on the cover seat 28. This locking ring 40 includes an undercut outer face 42 for intimate locking engagement with the rim of the opening and the inclined outer face 32 of the depending flange 30 surrounding the cover opening. As noted in the detail view of FIG. 5, the outer face 42 of the vent panel locking ring 40 will preferably have a beveled lower end 44 to facilitate an effective snap-locking of the panel locking ring 40 into engagement with the cover flange 30 by a downward pressure on the panel 16. Once engaged, a positive interlock is provided, preventing accidental release of the venting panel and requiring the positive application of manual pressure when removal of the panel is desired. As noted above, the edge portion 38 of the panel, where aligned with the cover recess 34, is of a width as to extend slightly outward beyond the recess inner wall 36 to provide an overhang, which can be engaged, by one's finger or fingers from within the recess. This in turn allows for a simple upward movement of the panel edge and a release of the panel from the cover opening. While both the cover and vent panel are substantially rigid, one or both will have sufficient resilient flexibility to allow for the desired engagement and release of the vent panel.

As previously described, the venting of the interior of the container or server is to be controlled, specifically providing for a venting of water vapor in the container and such internal gases and/or vapors as may develop from the nature of the food product itself, while at the same time, acting as a water barrier preventing the ingress of ambient moisture. The controlled venting is provided by a foil or film 46 bonded or molded to the undersurface of the vent panel 16 for the full extent thereof below the panel openings or perforations 48 and within the locking ring 40. In the preferred embodiment the vent panel 16 and the film or foil 46 are made of compatible materials that allow the vent panel 16 to be injection molded over the foil. The resulting bond between the vent panel 16 and the foiled 46 is quite strong and durable. Such breathable waterproof films are known, for example the films utilizing Pebax® breathable resins.

The permeability of such films or foils can be varied, that is they can be produced with different permeabilities in accord with the nature of the product involved, for example the particular type of cheese, and ambient conditions which might be encountered. It is also possible to adjust the permeability of the vent panel 16 by adjusting the surface area of the panel openings 48, thereby adjusting the surface area of the foil through which the vapor can pass.

With regard to the use of such a film or foil in the cheese server of the present invention, it is proposed that a series or set of interchangeable vent panels, each with a film or foil of different permeability, be provided for selective use as desired or required. As previously discussed, the interchangeable vent panels 16 could also be provided with a larger or smaller panel opening surface area as necessary.

As will be appreciated from the drawings, it is contemplated that the vent panel be coextensive with a major portion of the top area of the domed cover, both longitudinally and transversely, to maximize the effective venting.

Figure 6:
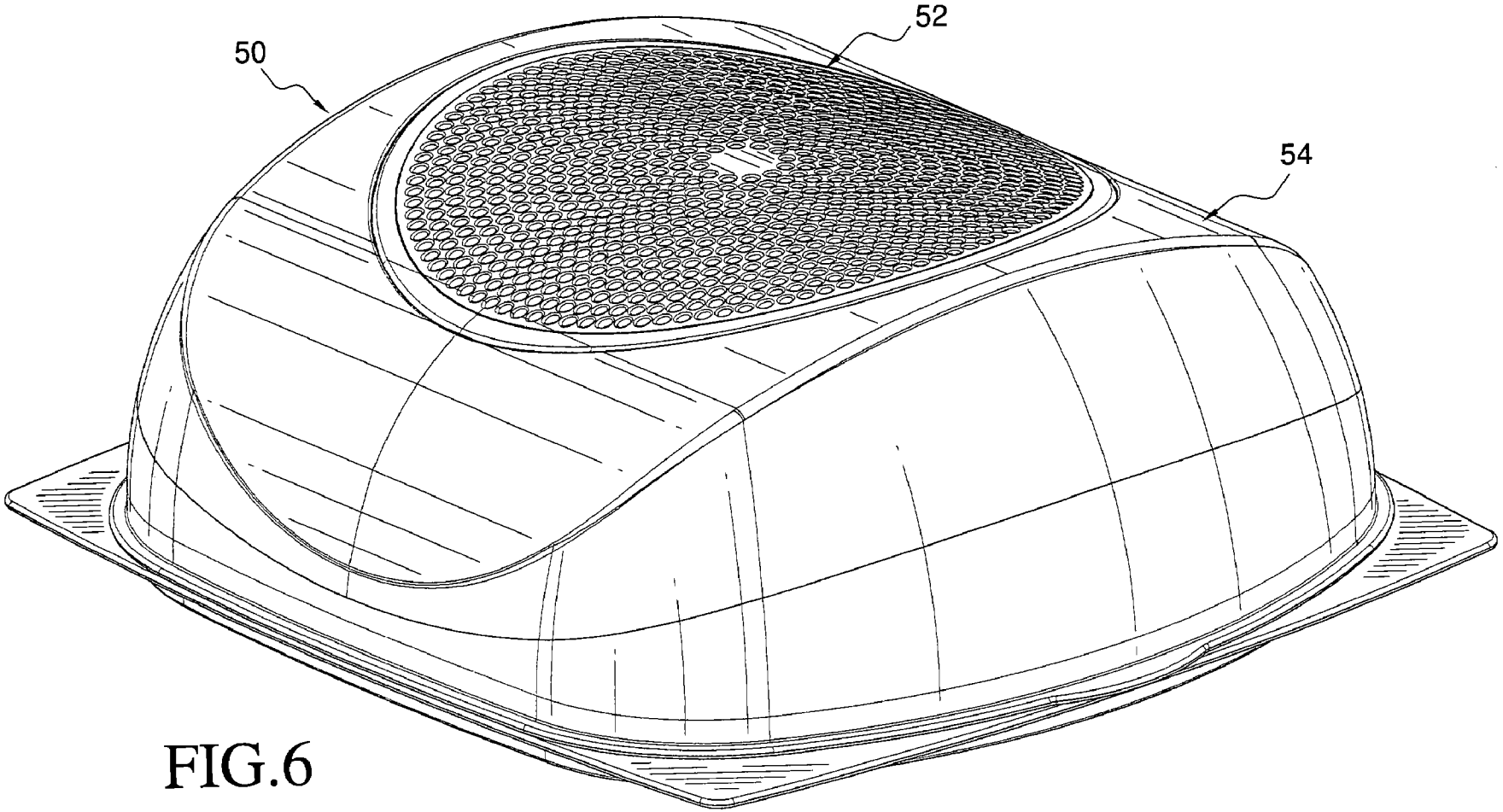
FIG. 6 is a perspective view of a square form of the server.
Figure 7:
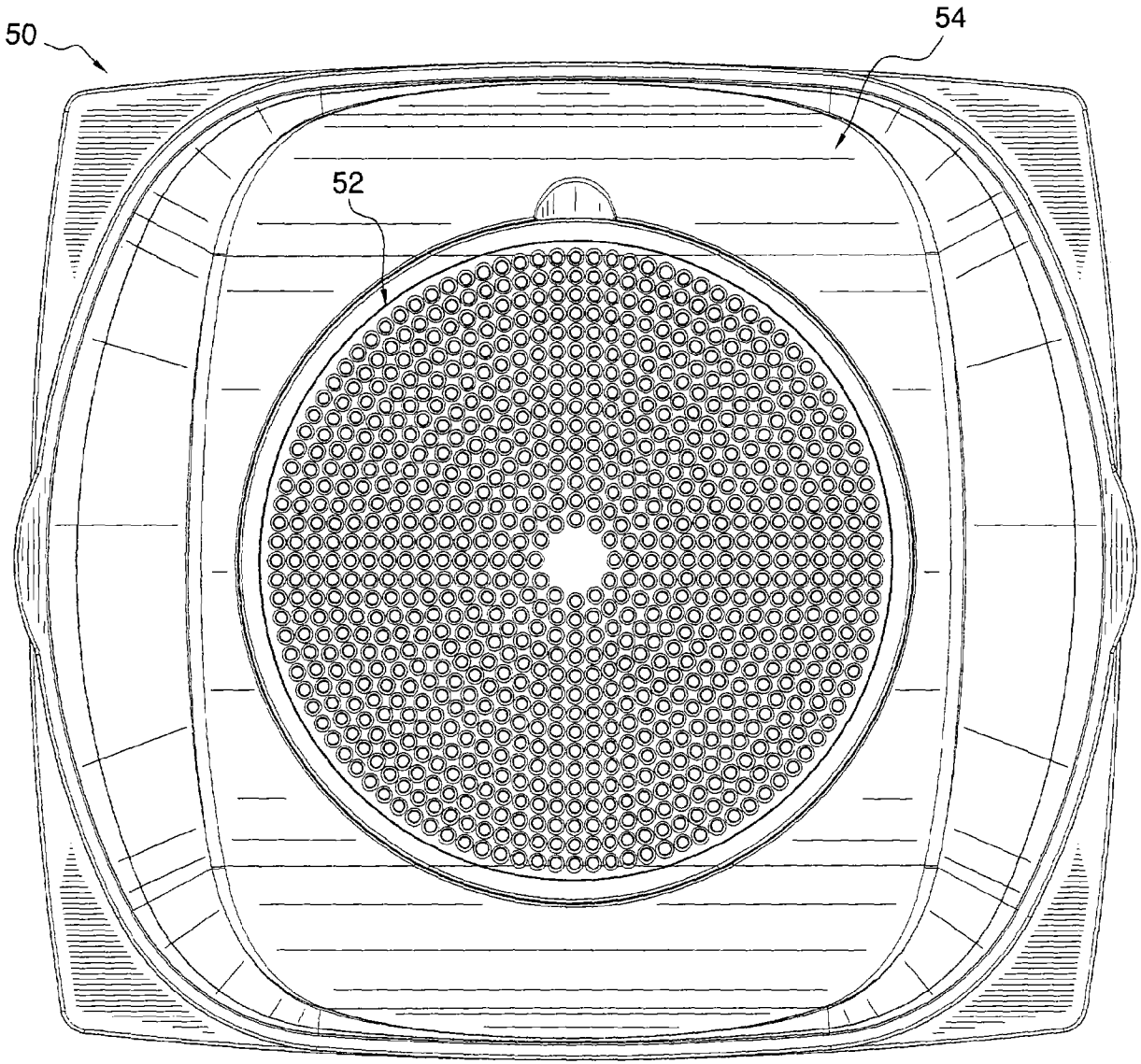
FIG. 7 is a top plan view of the square server.

FIGS. 6 and 7 are of interest in illustrating a container or cheese server 50, which is square in plan as opposed to the elongate rectangular configuration of the first embodiment. The container 50 will be provided with a circular vent panel 52 arcing, as desired, to conform to the specific configuration of the domed cover 54. The structural relationship between the components of the container 50 will be the same as that referred to with regard to the more specifically described first embodiment, the only difference being in size and shape as might be dictated by the particular food product to be contained. It is understood that while the preferred embodiment utilizes cheese as the primary example, other food products such as meats, may benefit from controlling the gases and vapor that develop in the interior of the container in which they are stored and served.

The foregoing is illustrative of the principles of the invention. While specific embodiments have been illustrated, other embodiments as encompassed within the scope of the appended claims will occur to those skilled in the art and are deemed to fall within the scope of the invention.

The invention claimed is:

1. A container for the preservation and serving of a food product, said container comprising a base tray, an upwardly extending dome-shaped cover is mounted over said tray to define a product receiving chamber, said dome-shaped cover defining an interior surface facing said tray and an exterior surface facing away from said tray, a vent opening in said cover, and a vent panel mountable to said cover exterior surface over said vent opening for control of atmospheric conditions within said chamber relative to ambient conditions, said vent opening being defined by a peripheral rim formed by the surrounding cover, said vent panel having a peripheral edge portion coextensive with said opening rim, wherein said vent panel is perforated with multiple holes over substantially the full extent of said panel to define a venting area, said venting area being coextensive with a substantial area of said cover, a foil of predetermined vapor permeability fixed between said vent opening and said panel in overlying relation to and coextensive with said venting area for a venting of vapors from said chamber to the ambient, and cooperating means on said panel edge portion and said rim for releasably snap locking said panel to said cover with said panel overlying and closing said opening.

2. The container of claim 1 wherein said foil is waterproof and precludes ingress of ambient moisture into said chamber.

3. The container of claim 2 wherein said means for releasably locking said panel to said cover comprises a depending locking ring on said vent panel inward of said peripheral edge portion and surrounding said perforated venting area, said locking ring being receivable inward through said vent opening adjacent said opening rim, said locking ring including an undercut face thereon receiving a portion of said rim for a snap locking thereto.

4. The container of claim 3 wherein said cover, adjacent said opening rim, is downwardly offset relative to adjacent portions of said cover and defines a peripheral seat for receiving the peripheral edge portion of said vent panel.

5. The container of claim 4 wherein a portion of said cover along a minor extent of said peripheral rim is inwardly offset to define a finger-accommodating recess underlying a section of the peripheral edge portion of the mounted vent panel for selective upward removal of said vent panel from the vent opening.

6. The container of claim 1 wherein a portion of said cover along a minor extent of said peripheral rim is inwardly offset to define a finger-accommodation recess underlying a section of the peripheral edge portion of the mounted vent panel for selective upward removal of said vent panel from the vent opening.

7. The container of claim 1 wherein said means for releasably locking said panel to said cover comprises a depending locking ring on said vent panel inward of said peripheral edge portion, said locking ring being receivable inward through said vent opening adjacent said opening rim, said locking ring including an undercut face thereon receiving a portion of said rim for a snap locking thereto, said vent panel being removable from said cover.

8. The container of claim 7 wherein said cover, adjacent said opening forming rim, is downwardly offset relative to adjacent portions of said cover and defines a peripheral seat for receiving the peripheral edge portion of said vent panel.

9. The container of claim 8 wherein said vent panel follows and conforms to the contour of the dome-shaped cover.

10. The container of claim 9 wherein a portion of said cover along a minor extent of said peripheral rim is inwardly offset to define a finger-accommodating recess underlying a section of the peripheral edge portion of the mounted vent panel for selective upward removal of said vent panel from the vent opening.

11. The container of claim 9 wherein said tray comprises a planar top serving surface with a depending peripheral flange defining a support for said top surface, and an outwardly projecting ledge peripherally about said depending flange at an intermediate height along the vertical extent thereof, said cover having a lower edge portion surrounding and enclosing said tray top surface and seating on said ledge.

12. The container of claim 1 wherein said tray comprises a planar top serving surface with a depending peripheral flange defining a support for said top surface, and an outwardly projecting ledge peripherally about said depending flange at an intermediate height along the vertical extent thereof, said cover having a lower edge portion surrounding and enclosing said tray top surface and seating on said ledge.

13. The container of claim 12 wherein said vent panel is perforated with multiple holes over substantially the full extent of said panel to define a venting area, said venting area being coextensive with a substantial area of said cover.

14. The container of claim 13 including a foil of predetermined vapor permeability bonded to said panel in overlying relation to and coextensive with said venting area for a venting of vapors from said chamber to the ambient atmosphere.

15. A cheese server comprising a tray having a planar top serving surface, an upwardly domed and downwardly open cover engaged with said tray and overlying and enclosing said tray top surface, said cover having an interior surface facing said tray and an exterior surface facing away from the tray, and a vent opening defined therein in upwardly spaced and generally parallel overlying relation to the top surface of said tray, a vent panel overlying and enclosing said opening on said exterior surface, wherein said vent panel is perforated with multiple holes over substantially the full extent of said panel to define a venting area, said venting area being coextensive with a substantial area of said cover, a foil of predetermined vapor permeability fixed between said vent opening and said panel in overlying relation to and coextensive with said venting area for a venting of vapors from said chamber to the ambient, and means for snap releasably locking said vent panel to said cover and over said opening.

16. The cheese server of claim 15 wherein said vent panel is waterproof and vapor permeable, and of predetermined vapor permeability.

17. The cheese server of claim 16 wherein said vent panel defines an area equal to a substantial portion of the area of the planar top surface of the tray.

* * * * *